US009982525B2

(12) United States Patent
Brooks et al.

(10) Patent No.: US 9,982,525 B2
(45) **Date of Patent: *May 29, 2018**

(54) UTILIZATION OF DYNAMIC DOWNHOLE SURVEYING MEASUREMENTS

(75) Inventors: Andrew G. Brooks, Tomball, TX (US); Junichi Sugiura, Stonehouse (GB)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 580 days.

This patent is subject to a terminal disclaimer.

(21) Appl. No.: 13/429,173

(22) Filed: Mar. 23, 2012

(65) Prior Publication Data

US 2013/0151158 A1 Jun. 13, 2013

Related U.S. Application Data

(63) Continuation-in-part of application No. 13/323,116, filed on Dec. 12, 2011, now Pat. No. 9,273,547.

(51) Int. Cl.
*G01V 3/00* (2006.01)
*E21B 47/022* (2012.01)

(52) U.S. Cl.
CPC ..... *E21B 47/022* (2013.01)

(58) Field of Classification Search
CPC ..... E21B 47/022
See application file for complete search history.

(56) References Cited

U.S. PATENT DOCUMENTS

| | | | |
|---|---|---|---|
| 4,163,324 | A | 8/1979 | Russell et al. |
| 4,682,421 | A | 7/1987 | van Dongen et al. |
| 4,709,486 | A | 12/1987 | Walters |
| 4,813,274 | A | 3/1989 | DiPersio et al. |
| 4,894,923 | A | 1/1990 | Cobern et al. |
| 4,999,920 | A | 3/1991 | Russell et al. |
| 5,012,412 | A | 4/1991 | Helm |
| RE33,708 | E | 10/1991 | Roseler |
| 5,128,867 | A | 7/1992 | Helm |
| 5,155,916 | A | 10/1992 | Engebretson |
| 5,321,893 | A | 6/1994 | Engebretson |
| 5,452,518 | A | 9/1995 | DiPersio |
| 5,564,193 | A | 10/1996 | Brooks |
| 5,623,407 | A | 4/1997 | Brooks |
| 6,728,639 | B2 | 4/2004 | Russell |

(Continued)

FOREIGN PATENT DOCUMENTS

| | | | |
|---|---|---|---|
| GB | 2301438 A | 12/1996 | |
| WO | WO 2006047523 A1 * | 5/2006 | ..... E21B 47/022 |

OTHER PUBLICATIONS

Blanz et al., CA-2584068.*

(Continued)

*Primary Examiner* — Hyun Park

(57) ABSTRACT

A method for making dynamic gravity toolface measurements while rotating a downhole measurement tool in a borehole is disclosed. The method includes processing magnetic field measurements and accelerometer measurements to compute a toolface offset and further processing the toolface offset in combination with a magnetic toolface to obtain the dynamic gravity toolface. Methods for correcting dynamic and static navigational sensor measurements to remove sensor biases, for example, are also disclosed.

9 Claims, 5 Drawing Sheets

(56) References Cited

U.S. PATENT DOCUMENTS

| | | | | |
|---|---|---|---|---|
| 6,966,211 | B2 | 11/2005 | Wu | |
| 7,650,269 | B2 | 1/2010 | Rodney | |
| 8,536,862 | B2 | 9/2013 | Kimura et al. | |
| 2002/0005298 | A1 | 1/2002 | Estes et al. | |
| 2002/0062076 | A1 | 5/2002 | Kandori et al. | |
| 2004/0149004 | A1 | 8/2004 | Wu | |
| 2004/0238222 | A1* | 12/2004 | Harrison | E21B 7/04 175/61 |
| 2006/0260843 | A1 | 11/2006 | Cobern | |
| 2007/0030007 | A1 | 2/2007 | Moore | |
| 2007/0203651 | A1 | 8/2007 | Blanz et al. | |
| 2007/0289373 | A1* | 12/2007 | Sugiura | E21B 7/062 73/152.46 |
| 2009/0030616 | A1 | 1/2009 | Sugiura | |
| 2009/0201025 | A1 | 8/2009 | McElhinney | |
| 2010/0250207 | A1 | 9/2010 | Rodney | |
| 2011/0147083 | A1* | 6/2011 | Mauldin | E21B 44/00 175/50 |
| 2013/0124095 | A1 | 5/2013 | Sugiura | |
| 2013/0151158 | A1 | 6/2013 | Brooks et al. | |
| 2013/0248247 | A1 | 9/2013 | Sugiura | |

OTHER PUBLICATIONS

Estes, et al., "Improvement of Azimuth Accuracy by Use of Iterative Total Field Calibration Technique and Compensation for System Environment Effects", SPE 19546—SPE Annual Technical Conference and Exhibition, San Antonio, Texas, Oct. 8-11, 1989, 12 pages.

Perry, et al., "Eddy Current Induction in a Solid Conducting Cylinder with a Transverse Magnetic Field", IEEE Transactions on Magnetics, vol. 14 (4), Jul. 1978, pp. 227-232.

Stockhausen, et al., "Continuous Direction and Inclination Measurements Lead to an Improvement in Wellbore Positioning", SPE Paper 79917—SPE/IADC Drilling Conference, Amsterdam, Netherlands, Feb. 19-21, 2003, 16 pages.

Williamson, H.S. , "Accuracy Prediction for Directional Measurement While Drilling", SPE Drilling & Completion, vol. 15 (4), Dec. 2000, pp. 221-233.

International Search Report and Written Opinion issued in the related PCT application PCT/US2012/068894, dated May 14, 2013 (10 pages).

International Preliminary Report on Patentability issued in the related PCT application PCT/US2012/068894, dated Jun. 17, 2014 (6 pages).

* cited by examiner

UTILIZATION OF DYNAMIC DOWNHOLE SURVEYING MEASUREMENTS

CROSS REFERENCE TO RELATED APPLICATIONS

This application is a continuation-in-part of co-pending, commonly assigned U.S. patent application Ser. No. 13/323,116 entitled "Dynamic Borehole Azimuth Measurements", filed Dec. 12, 2011.

FIELD OF THE INVENTION

Disclosed embodiments relate generally to measurement while drilling "MWD" methods and more particularly to a method for making a dynamic gravity toolface measurement while drilling.

BACKGROUND INFORMATION

In conventional measurement while drilling "MWD", borehole inclination and borehole azimuth are determined at a discrete number of longitudinal points along the axis of the borehole. The discrete measurements may be assembled into a survey of the well and used to calculate a three-dimensional well path (e.g., using the minimum curvature assumption). The use of accelerometers, magnetometers, and gyroscopes have been used in such conventional borehole surveying techniques for measuring borehole inclination and/or borehole azimuth. For example, borehole inclination is commonly derived from tri-axial accelerometer measurements of the earth's gravitational field. Borehole azimuth is commonly derived from a combination of tri-axial accelerometer and tri-axial magnetometer measurements of the earth's gravitational and magnetic fields.

Such static surveying measurements are made after drilling has temporarily stopped (e.g., when a new length of drill pipe is added to the drill string). While these static surveying measurements are often sufficient to obtain a well path of suitable accuracy, it is desirable to measure the borehole inclination and borehole azimuth dynamically (i.e., in substantially real time) while drilling as such measurements provide a more timely indication of the drilling direction. Dynamic borehole inclination values may be derived from an axial accelerometer measurement and an estimate (or previous measurement) of the total gravitational field. Such dynamic inclination measurements are commonly made in commercial drilling operations, for example, using the PZIG® and iPZIG® tools available from PathFinder®, A Schlumberger Company, Katy, Tex., USA.

Methods for making dynamic borehole azimuth measurements are also known. For example, the borehole azimuth may be derived while drilling from an axial magnetic field measurement and estimates of at least two local magnetic field components, such as magnetic dip and total magnetic field. This approach and other reported methods suffer from a number of deficiencies and are therefore not commonly implemented. For example, axial magnetic field measurements are particularly sensitive to magnetic interference emanating from nearby drill string components (e.g., including the drill bit, a mud motor, a reaming tool, and the like) rendering the technique unsuitable for near-bit applications. Moreover, the accuracy of the derived azimuth is poor when the azimuth is oriented close to magnetic north or magnetic south. Other reported methods require the use of transverse accelerometer measurements, which are often contaminated by lateral vibration and centripetal acceleration components due to drill string vibration, stick/slip, whirl, and borehole wall impacts.

SUMMARY

Methods for making dynamic borehole azimuth measurements while drilling a subterranean borehole are disclosed. In one or more embodiments, cross-axial magnetic field measurements are utilized to compute a magnitude of a cross-axial magnetic field component, which is in turn used in combination with accelerometer measurements to compute the dynamic borehole azimuth. The accelerometer measurements may include, for example, axial accelerometer measurements or both axial and cross-axial accelerometer measurements (e.g., tri-axial measurements). In one or more embodiments, the cross-axial magnetic field measurements and the accelerometer measurements are used to compute the magnitude of the cross-axial magnetic field component, a toolface offset, and a borehole inclination, which are in turn used to compute the dynamic borehole azimuth.

In other embodiments, dynamic navigational sensor measurements may be utilized to compute a dynamic gravity toolface while rotating a downhole measurement tool in a borehole. The dynamic gravity toolface may be used, for example, in borehole imaging applications and directional drilling steering decisions. The dynamic navigational sensor measurements may further be utilized to compute various correction factors, e.g., including sensor biases, that may be in-turn used to correct static survey measurements.

The disclosed embodiments may provide various technical advantages. For example, methods are provided for determining the dynamic borehole azimuth while drilling. These methods may be utilized in combination with a near bit sensor sub to compute a near bit dynamic borehole azimuth (e.g., within one or two meters from the bit). Various embodiments may also provide for improved accuracy in borehole imaging and directional drilling operations.

This summary is provided to introduce a selection of concepts that are further described below in the detailed description. This summary is not intended to identify key or essential features of the claimed subject matter, nor is it intended to be used as an aid in limiting the scope of the claimed subject matter.

BRIEF DESCRIPTION OF THE DRAWINGS

For a more complete understanding of the disclosed subject matter, and advantages thereof, reference is now made to the following descriptions taken in conjunction with the accompanying drawings, in which.

DETAILED DESCRIPTION

Figure 1:
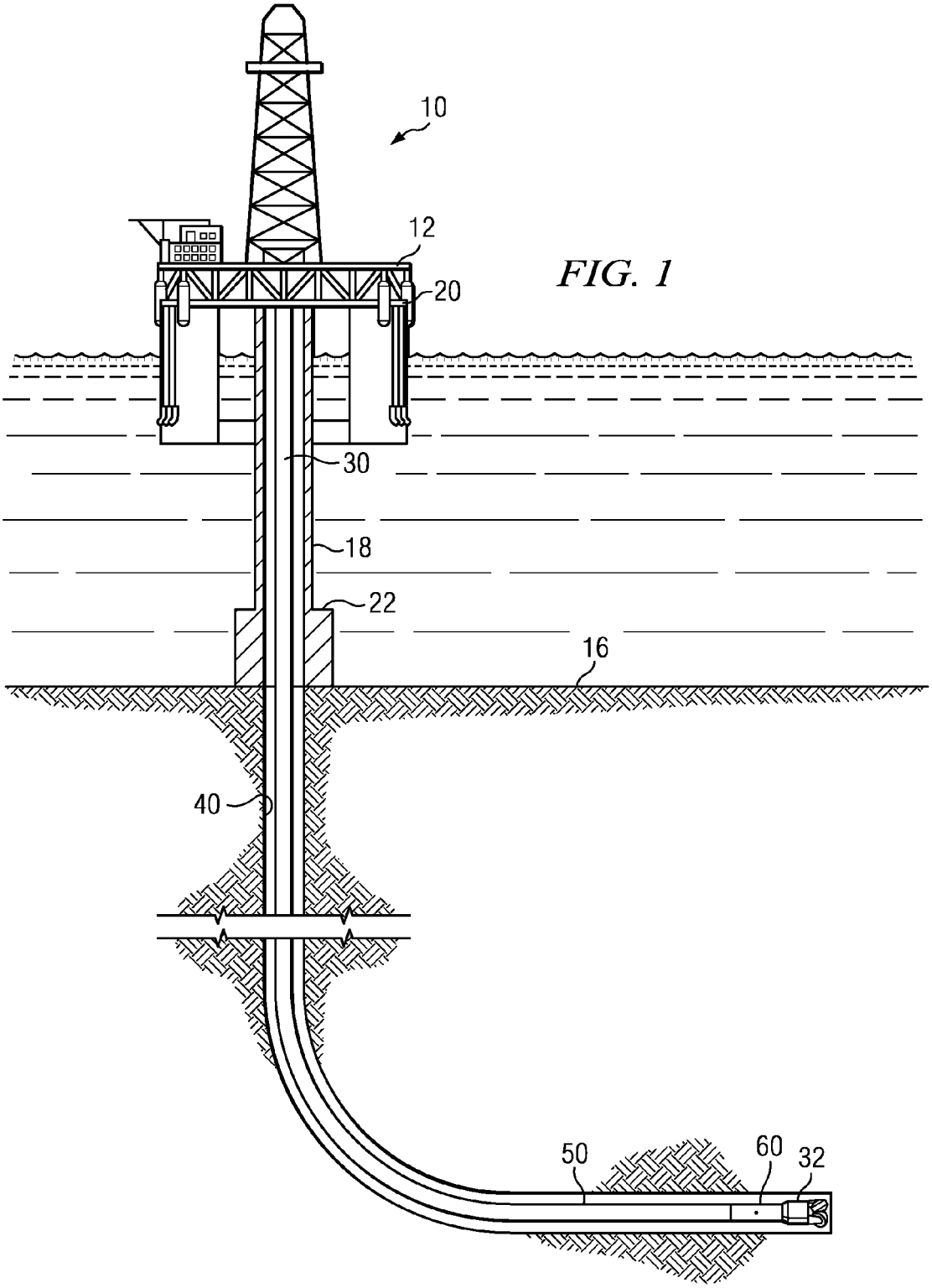
FIG. 1 depicts one example of a conventional drilling rig on which disclosed methods may be utilized.

FIG. 1 depicts a drilling rig 10 suitable for using various method embodiments disclosed herein. A semisubmersible drilling platform 12 is positioned over an oil or gas formation (not shown) disposed below the sea floor 16. A subsea conduit 18 extends from deck 20 of platform 12 to a wellhead installation 22. The platform may include a derrick and a hoisting apparatus for raising and lowering a drill string 30, which, as shown, extends into borehole 40 and includes a drill bit 32 and a near-bit sensor sub 60 (such as the iPZIG® tool available from PathFinder®, A Schlumberger Company, Katy, Tex., USA). Drill string 30 may further include a downhole drilling motor, a steering tool such as a rotary steerable tool, a downhole telemetry system, and one or more MWD or LWD tools including various sensors for sensing downhole characteristics of the borehole and the surrounding formation. The disclosed embodiments are not limited in these regards.

It will be understood by those of ordinary skill in the art that the deployment illustrated on FIG. 1 is merely an example. It will be further understood that disclosed embodiments are not limited to use with a semisubmersible platform 12 as illustrated on FIG. 1. The disclosed embodiments are equally well suited for use with any kind of subterranean drilling operation, either offshore or onshore.

Figure 2:
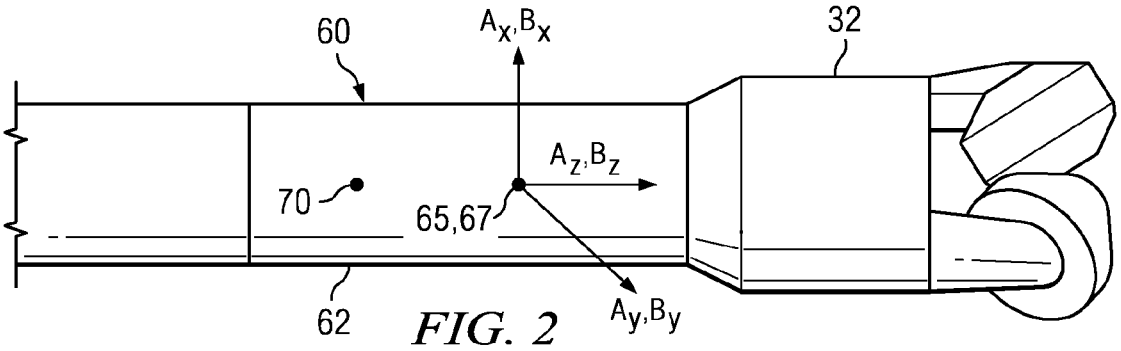
FIG. 2 depicts a lower BHA portion of the drill string shown on FIG. 1.

FIG. 2 depicts the lower BHA portion of drill string 30 including a drill bit 32 and a near-bit sensor sub 60. In the depicted embodiment, sensor sub body 62 is threadably connected with the drill bit 32 and therefore configured to rotate with the drill bit 32. The depicted sensor sub 60 includes tri-axial accelerometer 65 and magnetometer 67 navigation sensors and may optionally further include a logging while drilling sensor 70 such as a natural gamma ray sensor. In the depicted embodiment, the sensors 65 and 67 may be deployed as close to the drill bit 32 as possible, for example, within two meters, or even within one meter, of the drill bit 32.

Suitable accelerometers for use in sensors 65 and 67 may be chosen from among substantially any suitable commercially available devices known in the art. For example, suitable accelerometers may include Part Number 979-0273-001 commercially available from Honeywell, and Part Number JA-5H175-1 commercially available from Japan Aviation Electronics Industry, Ltd. (JAE). Suitable accelerometers may alternatively include micro-electro-mechanical systems (MEMS) solid-state accelerometers, available, for example, from Analog Devices, Inc. (Norwood, Mass.). Such MEMS accelerometers may be advantageous for certain near bit sensor sub applications since they tend to be shock resistant, high-temperature rated, and inexpensive. Suitable magnetic field sensors may include conventional ring core flux gate magnetometers or conventional magnetoresistive sensors, for example, Part Number HMC-1021D, available from Honeywell.

FIG. 2 further includes a diagrammatic representation of the tri-axial accelerometer and magnetometer sensor sets 65 and 67. By tri-axial it is meant that each sensor set includes three mutually perpendicular sensors, the accelerometers being designated as $A_x$, $A_y$, and $A_z$ and the magnetometers being designated as $B_x$, $B_y$, and $B_z$. By convention, a right handed system is designated in which the z-axis accelerometer and magnetometer ($A_z$ and $B_z$) are oriented substantially parallel with the borehole as indicated (although disclosed embodiments are not limited by such conventions). Each of the accelerometer and magnetometer sets may therefore be considered as determining a plane (the x and y-axes) and a pole (the z-axis along the axis of the BHA).

By convention, the gravitational field is taken to be positive pointing downward (i.e., toward the center of the earth) while the magnetic field is taken to be positive pointing towards magnetic north. Moreover, also by convention, the y-axis is taken to be the toolface reference axis (i.e., gravity toolface T equals zero when the y-axis is uppermost and magnetic toolface M equals zero when the y-axis is pointing towards the projection of magnetic north in the xy plane). Those of ordinary skill in the art will readily appreciate that the magnetic toolface M is projected in the xy plane and may be represented mathematically as: $\tan M = B_x/B_y$. Likewise, the gravity toolface T may be represented mathematically as: $\tan T = (-A_x)/(-A_y)$. Those of skill in the art will understand that the negative signs in the gravity toolface expression arise owing to the convention that the gravity vector is positive in the downward direction while the toolface angle T is positive on the high side of the borehole (the side facing upward).

It will be understood that the disclosed embodiments are not limited to the above described conventions for defining borehole coordinates. It will be further understood that these conventions can affect the form of certain of the mathematical equations that follow in this disclosure. Those of ordinary skill in the art will be readily able to utilize other conventions and derive equivalent mathematical equations.

Moreover, while FIGS. 1 and 2 depict a near-bit sensor sub 60, it will be understood that in certain embodiments the navigational sensors may be deployed in substantially any suitable downhole tool, for example, including an MWD tool, an LWD tool, a rotary-steerable tool, a downhole dynamics sensor sub, a coiled-tubing tool, an instrumented downhole motor, underreamers, and/or drill bit, and the like.

The accelerometer and magnetometer sets are typically configured for making downhole navigational (surveying) measurements during a drilling operation. Such measurements are well known and commonly used to determine, for example, borehole inclination, borehole azimuth, gravity toolface, and magnetic toolface. Being configured for making navigational measurements, the accelerometer and magnetometer sets 65 and 67 are rotationally coupled to the drill bit 32 (e.g., rotationally fixed to the sub body 62 which rotates with the drill bit). The accelerometers are also typically electronically coupled to a digital controller via a low-pass filter (including an anti-aliasing filter) arrangement. Such "DC coupling" is generally preferred for making accelerometer based surveying measurements (e.g., borehole inclination or gravity toolface measurements). The use of a low-pass filter band-limits sensor noise (including noise caused by sensor vibration) and therefore tends to improve sensor resolution and surveying accuracy.

While FIG. 2 depicts a tool configuration including tri-axial accelerometer 65 and magnetometer 67 sets, it will be understood that the disclosed embodiments are not limited in this regard. In particular, methods are disclosed for making dynamic borehole azimuth measurements without the use of axial (z-axis) magnetic field measurements. Disclosed methods may therefore also make use of a cross-axial magnetometer set (x- and y-axis magnetometers) or even a single cross-axial magnetometer.

Figure 3:
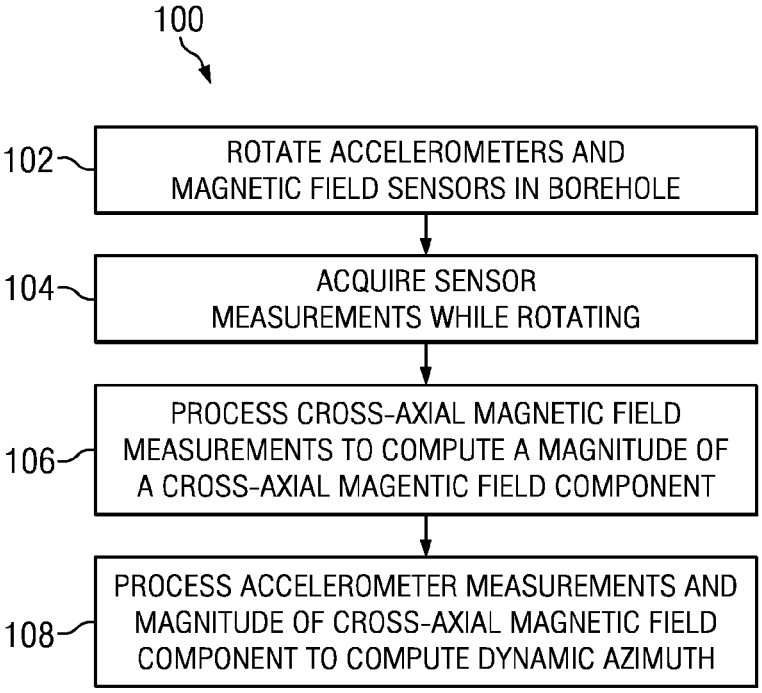
FIG. 3 depicts a flow chart of one disclosed method embodiment.

FIG. 3 depicts a flow chart of one example of a method 100 for making dynamic borehole azimuth measurements while drilling. Navigational sensors are rotated in a borehole at 102, for example, while drilling the borehole (by either rotating the drill string at the surface or rotating the drill bit with a conventional mud motor). The navigational sensors may include a tri-axial accelerometer set and a tri-axial magnetometer set, for example, as described above with respect to FIG. 2 (although the disclosed embodiments are not limited in this regard). Moreover, the sensors may be deployed as close to the bit as possible, for example, in a near-bit sensor sub as is also described above with respect to FIGS. 1 and 2.

Accelerometer and magnetometer measurements are made at a predetermined time interval at 104 while rotating in 102 (e.g., during the actual drilling process) to obtain corresponding sets (or arrays) of measurement data. In one example, the measurements include at least axial accelerometer measurements ($A_z$) and first and second cross-axial magnetometer measurements ($B_x$ and $B_y$). In another example, the measurements include tri-axial accelerometer measurements ($A_x$, $A_y$, and $A_z$) and first and second cross-axial magnetometer measurements.

The cross-axial magnetometer measurements are processed at 106 to compute a magnitude of a cross-axial magnetic field component B. The accelerometer measurements and the magnitude of the cross-axial magnetic field component are further processed at 108 to obtain the dynamic borehole azimuth. For example, as described in more detail below, the dynamic borehole azimuth may be computed from an axial accelerometer measurement and the magnitude of the cross-axial magnetic field component. In another example, the dynamic borehole azimuth can be computed from tri-axial accelerometer measurements and the cross-axial magnetic field component. These computations do not require an axial magnetic field measurement.

In one aspect, a method for making a dynamic borehole azimuth measurement while rotating a downhole measurement tool in a borehole includes: (a) rotating a downhole tool in the borehole, the downhole tool including a cross-axial magnetic field sensor and an axial accelerometer; (b) obtaining a set of cross-axial magnetic field measurements and a set of axial accelerometer measurements while the downhole tool is rotating in (a); (c) processing the set of cross-axial magnetic field measurements obtained in (b) to compute a magnitude of a cross-axial magnetic field component; and (d) processing the magnitude of the cross axial magnetic field component computed in (c) and the set of axial accelerometer measurements obtained in (b) to compute the dynamic borehole azimuth.

In another aspect a method for making a dynamic borehole azimuth measurement while rotating a downhole measurement tool in a borehole includes (a) rotating a downhole tool in the borehole, the downhole tool including a cross-axial magnetic field sensor, an axial accelerometer, and a cross-axial accelerometer; (b) obtaining a set of cross-axial magnetic field measurements, a set of axial accelerometer measurements, and a set of cross-axial accelerometer measurements while the downhole tool rotates in (a); (c) processing the set of cross-axial magnetic field measurements obtained in (b) to compute a magnitude of a cross-axial magnetic field component; and (d) processing the magnitude of the cross axial magnetic field component computed in (c) and the set of axial accelerometer measurements and the set of cross-axial accelerometer measurements obtained in (b) to compute the dynamic borehole azimuth.

With continued reference to FIG. 3, the accelerometer and magnetometer measurements made at 104 may be made at a rapid time interval so as to provide substantially real-time dynamic borehole azimuth measurements. For example, the time interval may be in a range from about 0.0001 to about 0.1 second (i.e., a measurement frequency in a range from about 10 to about 10,000 Hz). In one embodiment a time interval of 10 milliseconds (0.01 second) may be utilized. These measurements may further be averaged (or smoothed) over longer time periods as described in more detail below.

The magnitude of the cross-axial magnetic field component may be obtained from the cross-axial magnetic field measurements $B_x$ and $B_y$, for example, as follows:

$$B_{xy}=\sqrt{B_x^2+B_y^2} \qquad \text{Equation 1}$$

An average $B_{xy}$ value may be computed, for example, by averaging a number of measurements over some predetermined time period (e.g., 30 seconds). Such averaging tends to remove oscillations in $B_{xy}$ caused by misalignment of the sensor axes. Averaging also tends to reduce measurement noise and improve accuracy.

The magnitude of the cross-axial magnetic field component may alternatively be obtained from the sets of cross-axial magnetic field measurements as follows:

$$B_{xy}=\sqrt{2\cdot\sigma_{Bx}\cdot\sigma_{By}} \qquad \text{Equation 2}$$

where $\sigma_{Bx}$ and $\sigma_{By}$ represent the standard deviations of a set of $B_x$ and $B_y$ measurements made over several complete rotations of the tool (e.g., in a 30 second time period during normal drilling rotation rates).

Figure 4:
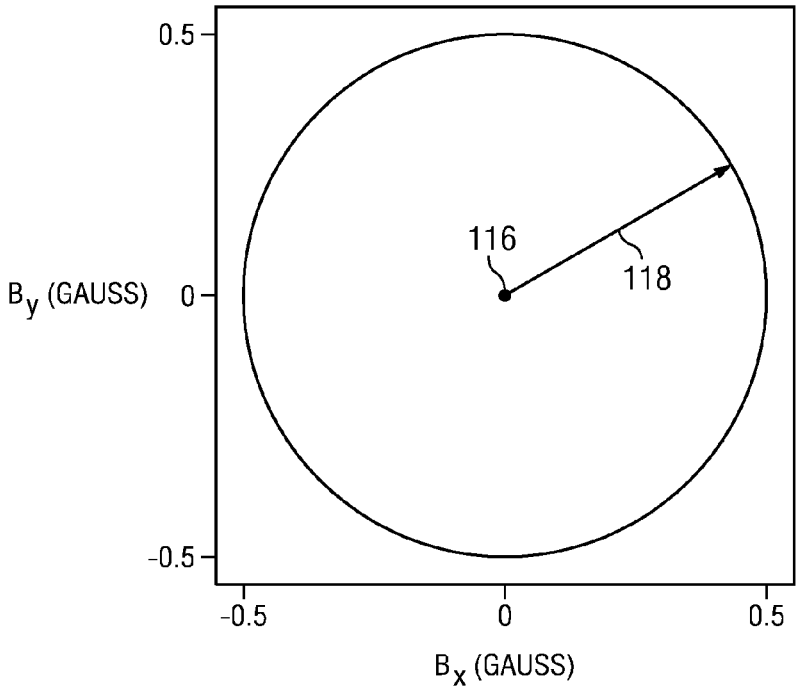
FIG. 4 depicts a plot of $B_x$ versus $B_y$ for a set of magnetic field measurements.

It may be advantageous in certain applications or tool configurations to remove DC offset and scale factor errors from the measured $B_x$ and $B_y$ values. This may be accomplished, for example, via plotting $B_x$ versus $B_y$ for a set of measurements (e.g., 3000 measurements made over a 30 second time period). FIG. 4 depicts an example of one such plot in which the center location 116 represents the DC offset errors for $B_x$ and $B_y$ and the radius of the circle 118 represents $B_{xy}$. In the depicted example, the offset values are small as compared to the radius. In the absence of scale errors and misalignments, the plot is a perfect circle. The presence of these errors tends to result in an elliptical plot in which the relative scale errors and misalignments may be estimated from the values of the major and minor axes of the ellipse.

More rigorous least squares analysis may also be used to find and remove errors due to various biases, scale factors, and non-orthogonality of the computed $B_{xy}$. For example, parameter values may be selected that minimize the following mathematical equation:

$$\Sigma[\sqrt{B_{xc}^2+B_{yc}^2}-B_{xy}]^2 \qquad \text{Equation 3}$$

where $B_{xc}$ and $B_{yc}$ represent corrected $B_x$ and $B_y$ measurements after the corrections have been applied and $\Sigma$ represents the summation over all samples in the interval. This method is similar to that taught by Estes (in Estes and Walters, *Improvement of Azimuth Accuracy by Use of Iterative Total Field Calibration Technique and Compensation for System Environment Effects*, SPE Paper 19546, October, 1989). These corrections may be applied using either uphole or downhole processors. Other similar approaches are also known to those of ordinary skill in the art.

In certain operations it may be advantageous to dynamically calibrate the magnetometers while drilling via applying the above described corrections on downhole processors. For example, such calibration may be employed each time an additional pipe stand is added to the drill string. The downhole processor may be configured to run a calibration routine each time the flow of drilling fluid is turned back on. The calibration may include collecting a large number of measurements over some predetermined time period (e.g., 3000 measurements in a 30 second interval) while rotating the tool in the borehole. The corrections described above with respect to FIG. 4 or Equation 3 may then be applied to the set of magnetometer measurements. Determination of various sensor errors (e.g., D.C. bias, scale factor, and non-orthogonality) in this way may enable either previously collected or subsequently collected static and/or dynamic magnetometer data to be corrected.

It will be understood that the above described dynamic calibration is not limited to magnetometer measurements but may also be applied to accelerometer measurements. The process of dynamically calibrating accelerometer measurements is substantially identical to that described above with respect to FIG. 4 and Equation 3. For example, Equation 3 may be re-written as follows:

$$\Sigma[\sqrt{A_{xc}^2+A_{yc}^2}-A_{xy}]^2 \qquad \text{Equation 3.1}$$

where $A_{xc}$ and $A_{yc}$ represent corrected $A_x$ and $A_y$ measurements (x- and y-axis accelerometer measurements) after the corrections have been applied and Σ represents the summation over all samples in the interval. As with Equation 3, parameter values may be selected that minimize Equation 3.1.

Navigational sensors are commonly utilized in LWD tools and rotary-steerable tools. These sensors are not always rigorously calibrated prior to use. It may therefore be advantageous to apply the aforementioned dynamic calibration downhole while drilling. MWD navigational sensors are typically well calibrated in a manufacturing process and are further recalibrated periodically (e.g. every year or every 6 months) in a maintenance process. Notwithstanding, the bias sensor errors may become problematic between formal calibrations. Therefore, there may be occasions where it is advantageous to apply this dynamic calibration method to MWD tools as well.

The above describe dynamic calibration may be advantageous in various drilling and surveying operations in which the x- and y-axis accelerometer and/or magnetometer readings are small. For example, when drilling at near vertical angles (e.g., inclination angles less than about 10 degrees), the x- and y-axis accelerometer readings are typically small. In such applications, the accelerometer bias error may be relatively large compared to the total gravitational field and if left uncorrected can lead to significant errors in the computed borehole azimuth and gravity toolface. Likewise, when drilling toward the magnetic dip angle (e.g., within about 10 degrees), the x- and y-axis magnetometer readings are typically less than 0.1 Gauss. In such applications, the magnetometer bias error may be relatively large compared to the total magnetic field and if left uncorrected can lead to significant errors in the computed borehole azimuth. The aforementioned dynamic calibrations may also be advantageous in certain geographical locations in which the magnetic field of the earth is low.

In one aspect, a method for dynamically calibrating rotating navigational sensors deployed in a subterranean borehole is disclosed. The method may include (a) rotating a downhole tool in the borehole, the downhole tool including first and second cross-axial navigational sensors; (b) obtaining first and second cross-axial navigation sensor measurements while the downhole tool is rotating in (a); and (c) processing the navigational sensor measurements obtained in (b) by fitting the navigational sensor measurements with a circular function to obtain corrected cross-axial navigational sensor measurements.

Magnetometer and accelerometer biases may also be quantified and removed from the corresponding measurements, for example, as follows. The measured accelerometer and/or magnetometer data may be expressed mathematically in vector form, for example, as follows:

$$D_x(i)=D_{xy}\sin M(i)+eD_x \qquad \text{Equation 3.2}$$

$$D_y(i)=D_{xy}\cos M(i)+eD_y \qquad \text{Equation 3.3}$$

where $D_x(i)$ and $D_y(i)$ represent the accelerometer or magnetometer data, M(i) represent toolface angles corresponding to the $i^{th}$ accelerometer or magnetometer data point, $D_{xy}$ represents and magnitude of the cross axial magnetic or gravitational field component, and $eD_x$ and $eD_y$ represent the bias errors. In practice the measured sensor data (the accelerometer or magnetometer data) are used to solve for the unknowns: $D_{xy}$, $eD_x$ and $eD_y$. The following parameters may be used in solving for these unknowns:

$$a=2[D_x(i+1)-D_x(i)] \qquad \text{Equation 3.4}$$

$$b=2[D_y(i+1)-D_y(i)] \qquad \text{Equation 3.5}$$

$$c=D_x(i)^2+D_y(i)^2-D_x(i+1)^2-D_y(i+1)^2 \qquad \text{Equation 3.6}$$

These parameters may be expanded using Equations 3.2 and 3.3 to obtain the following:

$$a(i)=2D_{xy}[\sin M(i+1)-\sin M(i)] \qquad \text{Equation 3.7}$$

$$b(i)=2D_{xy}[\cos M(i+1)-\cos M(i)] \qquad \text{Equation 3.8}$$

$$c(i)=2D_{xy}eD_x[\sin M(i)-\sin M(i+1)]+2D_{xy}eD_y[\cos M(i)-\cos M(i+1)] \qquad \text{Equation 3.9}$$

From Equations 3.7, 3.8, and 3.9:

$$c(i)=-[a(i)eD_x+b(i)eD_y] \qquad \text{Equation 3.10}$$

The following linear equations (i.e., linearly related to the bias error terms) may be obtained by summing the parameters given above in Equations 3.7, 3.8, and 3.9.

$$sac=-(eD_x saa+eD_y sab) \qquad \text{Equation 3.11}$$

$$sbc=-(eD_x sab+eD_y sbb) \qquad \text{Equation 3.12}$$

where N represents the number of measurements, $$saa=\sum_{i=1}^{N} a(i)^2,\ sbb=\sum_{i=1}^{N} b(i)^2,\ sab=\sum_{i=1}^{N} a(i)\cdot b(i),$$

$$sac=\sum_{i=1}^{N} a(i)\cdot c(i),\ \text{and}\ sbc=\sum_{i=1}^{N} b(i)\cdot c(i).$$

The bias errors may then be obtained, for example, as follows:

$$eD_x=\frac{sab\cdot sbc-sbb\cdot sac}{saa\cdot sbb-sab^2} \qquad \text{Equation 3.13}$$

$$eD_y=\frac{sab\cdot sac-saa\cdot sbc}{saa\cdot sbb-sab^2} \qquad \text{Equation 3.14}$$

Upon computing the bias errors in Equations 3.13 and 3.14, these errors may be utilized to correct either dynamic or static navigational sensor measurements. For example, in one aspect a method for correcting static navigational sensor measurements using dynamic navigational sensor measurements may include: (a) deploying a downhole tool in a subterranean borehole, the downhole tool including first and second cross-axial navigational sensors; (b) obtaining first and second static cross-axial navigation sensor measurements while the downhole tool is substantially non-rotating with respect to the borehole; (c) rotating the downhole tool in the borehole; (d) obtaining dynamic cross-axial navigational sensor measurements while the downhole tool is rotating in (c); (e) processing the dynamic cross-axial navigational sensor measurements obtained in (d) to compute a bias for each of the first and second cross-axial navigational sensors; and (f) processing the bias computed in (e) with the static navigational sensor measurements obtained in (b) to obtain corrected static navigational sensor measurements.

Bias and scale errors may also be estimated using multi-station analysis. For example, a set of correction parameters including biases and scale errors for each of the three axes, a zero-rpm tool face offset, and a rpm-dependent offset correction factor may be computed so as to minimize the root mean square magnetic field deviation over a drilled interval. Such a magnetic field deviation is a scalar and represents the vector distance between the calculated magnetic vector and the reference vector. In order to evaluate the rpm-dependent offset correction factor, the drilled interval may make use of multiple drill string rotation rates (e.g., a sliding interval and a rotating interval, or a change in the rotation rate of the drill string before and/or after a connection).

In embodiments in which the magnetometers are deployed in close proximity to a mud motor, $B_{xy}$ may be attenuated due to an induced magnetization effect in the motor. Due to its high magnetic permeability, the magnetic field may be distorted near the motor thereby causing a portion of the total cross-axial flux to by-pass the magnetometers. While this effect is commonly small, it may be advantageous to account for such attenuation. Three-dimensional finite element modeling indicates that the attenuation can be on the order of a few percent when the magnetic field sensors are deployed within a foot or two of the motor. For example, when the sensors are axially spaced by about 11 inches from the motor, the attenuation is estimated to be about 3 percent for a 4.75 inch diameter motor, about 5 percent for a 6.75 inch diameter motor, and 7 percent for an 8 inch diameter motor.

Upon obtaining the cross-axial magnetic field component $B_{xy}$ and an axial accelerometer measurement, the borehole azimuth Azi may be computed, for example, as follows:

$$\cos Azi = \frac{\frac{\sqrt{B^2 - B_{xy}^2}}{B} - \frac{A_z}{G}\sin D}{\sin\left[\arccos\left(\frac{A_z}{G}\right)\right]\cos D} \qquad \text{Equation 4}$$

where $A_z$ represents an axial accelerometer measurement, G represents the magnitude of the earth's local gravitational field, B represents the magnitude of the earth's local magnetic field, and D represents the local magnetic dip angle.

Those of ordinary skill in the art will readily be able to obtain values for the magnetic reference components B and D, for example, from local magnetic surveys made at or below the earth's surface, from measurements taken at nearby geomagnetic observatories, from published charts, and/or from mathematical models of the earth's magnetic field such as the International Geomagnetic Reference Field "IGRF", the British Geological Survey Geomagnetic Model "BGGM", and/or the High Definition Geomagnetic Model "HDGM". The reference components may also be obtained from a non-rotating (static) survey, for example, using sensors spaced from magnetic drill string components and methods known to those of ordinary skill in the art.

The reference component G may also be obtained, for example, using geological surveys, on-site surface measurements, and/or mathematical models. The magnitude of the earth's local gravitational field G may also be obtained from static accelerometer measurements made downhole, e.g via $G=\sqrt{(A_x^2+A_y^2+A_z^2)}$. The disclosed embodiments are not limited to any particular methodology for obtaining B, D, or G.

In an alternative embodiment, the borehole azimuth may be computed from the magnitude of the cross-axial magnetic field component $B_{xy}$ by applying a short collar correction, for example, as follows:

$$P \sin Azi + Q \cos Azi + R \sin Azi \cdot \cos Azi = 0 \qquad \text{Equation 5}$$

where P, Q, and R may be computed from the borehole inclination I, the toolface offset (T−M), and the magnitude of the cross-axial magnetic field component $B_{xy}$, for example as follows:

$$P = B \sin D \cdot \sin I \cdot \cos I + B_{xy} \cos I \cdot \cos(T-M)$$

$$Q = B_{xy} \sin(T-M); \text{ and}$$

$$R = B \cos D \cdot \sin^2 I$$

and where B and D are as defined above with respect to Equation 4, and T and M represent the gravity toolface and the magnetic toolface as are also described above. A dynamic borehole inclination I (also referred to herein as the borehole inclination) may be computed from the axial accelerometer measurements, for example, as follows: $\cos I = A_z/G$, where $A_z$ represents the axial accelerometer measurement and G represents the magnitude of the earth's local gravitational field.

Equation 5 expresses the borehole azimuth as a function of three primary inputs that are invariant under rotation (i.e., the rotation of the drill string about its longitudinal axis): (i) the magnitude of the cross-axial magnetic field component $B_{xy}$, (ii) the toolface offset (T−M), and (iii) the borehole inclination I. Acquisition of the cross-axial magnetic field component $B_{xy}$ is described above. The toolface offset and the magnitude of the cross-axial magnetic field component may be obtained, for example, using a single cross-axial accelerometer and a single cross-axial magnetometer. In such an embodiment, $B_{xy}$ is the magnitude of the approximately sinusoidal wave (i.e., a periodic variation) traced out the by cross-axial magnetometer response and (T−M) is the phase difference between approximately sinusoidal waves traced out by the cross-axial magnetometer and cross-axial accelerometer responses.

The tool face offset (T−M) may also be obtained using sensor configurations having first and second cross-axial accelerometers and first and second cross-axial magnetometers (e.g., the x- and y-axis accelerometers and magnetometers in tri-axial sensor sets). For example, the toolface offset may be computed according to the following mathematical expression:

$$T - M = \arctan\frac{(-A_x)}{(-A_y)} - \arctan\frac{B_x}{B_y} \qquad \text{Equation 6}$$

The cross-axial accelerometer measurements are generally noisy due to downhole vibrations commonly encountered during drilling. The toolface offset values may therefore be averaged over many samples (e.g., 3000) to reduce noise.

In order to reduce the complexity of the downhole calculations (i.e., to reduce the number of times complex functions such as arctan are processed), the toolface offset may alternatively be computed over a number of measurements, for example, as follows:

$$T - M = \arctan\left[\frac{\sum (B_x A_y - B_y A_x)}{-\sum (B_x A_x + B_y A_y)}\right] \quad \text{Equation 7}$$

where $B_{xc}$ and $B_{yc}$ from Equation 3 may optionally be substituted for $B_x$ and $B_y$.

It will be understood that the toolface offset may be contaminated with various errors, for example, due to asynchronicity between accelerometer and magnetometer channels and eddy current effects caused by the conductive drill string rotating in the earth's magnetic field. These errors can (at times) be several degrees in magnitude and may therefore require compensation. Several compensation methods may be employed, for example, including peripheral placement of the magnetometers in the downhole measurement tool so as to reduce eddy current effects, corrections based upon mathematical analysis of filter delays and eddy currents, and a selection of filter parameters that reduce measurement offsets. Compensation methods may also account for toolface offset changes caused by a change in the rotation rate of the drill string.

Figure 5:
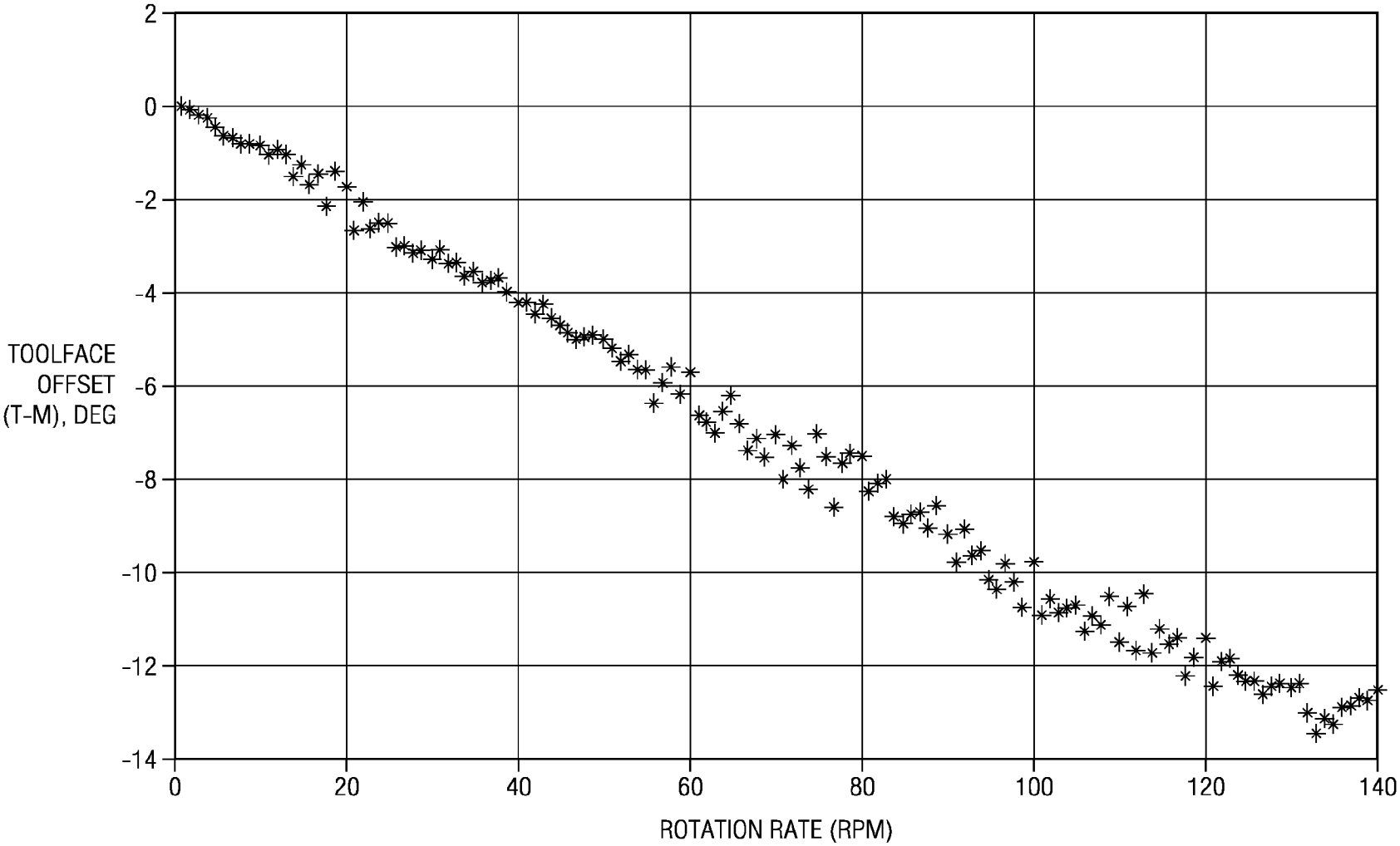
FIG. 5 depicts a plot of toolface offset versus the rotation rate of a downhole measurement tool.

FIG. 5 depicts a plot of toolface offset (in units of degrees) versus the rotation rate of the measurement tool in the borehole (in units of rpm). In the depicted plot, the toolface offset is observed to be a linear function of the rotation rate having a slope of about −0.1 degrees/rpm (i.e., decreasing about two degrees per 20 rpm). During drilling, the rotation rate of the measurement tool may be obtained via any known method, for example, via differentiating sequential magnetic toolface measurements as follows:

$$R = \frac{30}{\pi}\left[\frac{M(n) - M(n-1)}{t}\right] \quad \text{Equation 8}$$

where R represents the rotation rate in units of rpm, M represents the magnetic toolface, t represents the time between sequential measurements (e.g., 10 milliseconds), and n represents the array index in the set of magnetic toolface measurements such that M(n−1) and M(n) represent sequential magnetic toolface measurements. Those of ordinary skill will be readily able to re-write Equation 8 such that the rotation rate is expressed in alternative units such as in radians per second, radians per minute, or degrees per second.

One procedure for accounting for toolface offset changes with rotation rate includes measuring the toolface offset during a period when the rotation rate of the drill string is varying, for example, when drill string rotation slows prior to making a new connection, when it speeds up following the connection, or when it alternates between high and low rotation rates between rotary and slide drilling. In regions where the well path has high curvature, it may be desirable for the driller to minimize axial motion of the drill string while the rotation rate is varying so that the data may be collected at a single attitude. A rotation-dependent offset error may then be found, for example, from a plot of toolface offset versus rotation rate (e.g., as depicted on FIG. 5). A least squares analysis may also be employed to determine an appropriate fitting function (e.g., a nonlinear function when appropriate). An offset correction may be applied so as to reduce the toolface offset to its zero-rpm equivalent value prior to its use in Equation 5.

The toolface offset determined above with respect to Equations 6 and/or 7 and FIG. 5 (also referred to herein as the dynamic toolface offset) may also be utilized in logging while drilling (LWD) imaging applications and rotary steerable applications in which the survey sensors rotate with respect to the borehole (e.g., with the bit). In conventional LWD imaging and rotary steerable applications, magnetic toolface measurements made while drilling may be converted to gravity toolface using a static toolface offset (i.e., via adding the static toolface offset to the magnetic toolface). The static toolface offset is determined from static survey measurements. While this approach can sometimes work well in straight and low dogleg severity borehole sections, it may introduce significant toolface errors in high dogleg severity borehole sections (since the static toolface offset can change significantly between static survey stations). Moreover, by ignoring the rotation rate effects on the toolface offset depicted on FIG. 5, even larger errors may be introduced.

Figure 7:
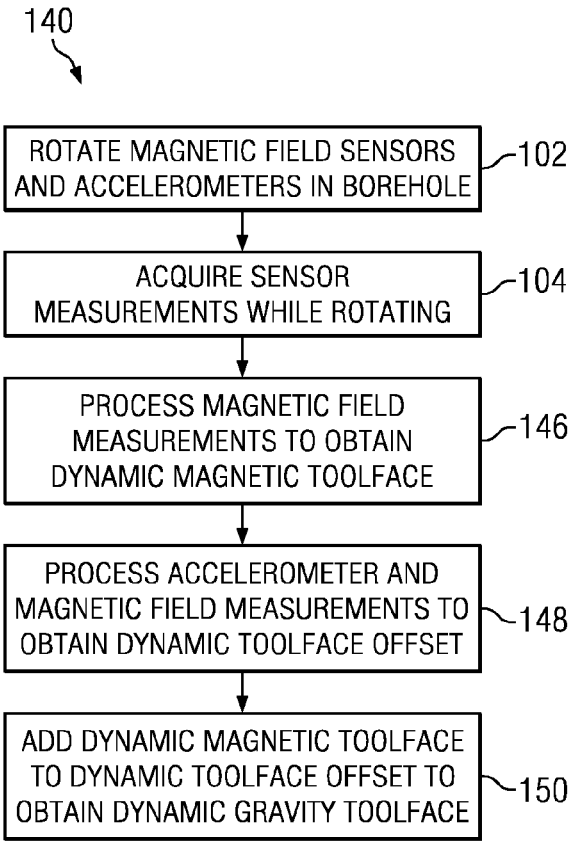
FIG. 7 depicts a flow chart of still another disclosed method embodiment.

FIG. 7 depicts a flow chart of a method 140 for making dynamic gravity toolface measurements while drilling. Navigational sensors are rotated in a borehole at 102 and used to acquire gravitational field and magnetic field measurements at 104 as described above with respect to FIG. 3. The magnetic field measurements are processed at 146 to obtain a dynamic magnetic toolface. The gravitational and magnetic field measurements are further processed at 148 to obtain a dynamic toolface offset. The processing at 148 may include the use of Equations 6 or 7 and a rotation rate correction such as that depicted on FIG. 5. The dynamic gravity toolface may then be determined at 150 via adding dynamic toolface offset obtained at 148 to the dynamic magnetic toolface obtained at 146.

Figure 8:
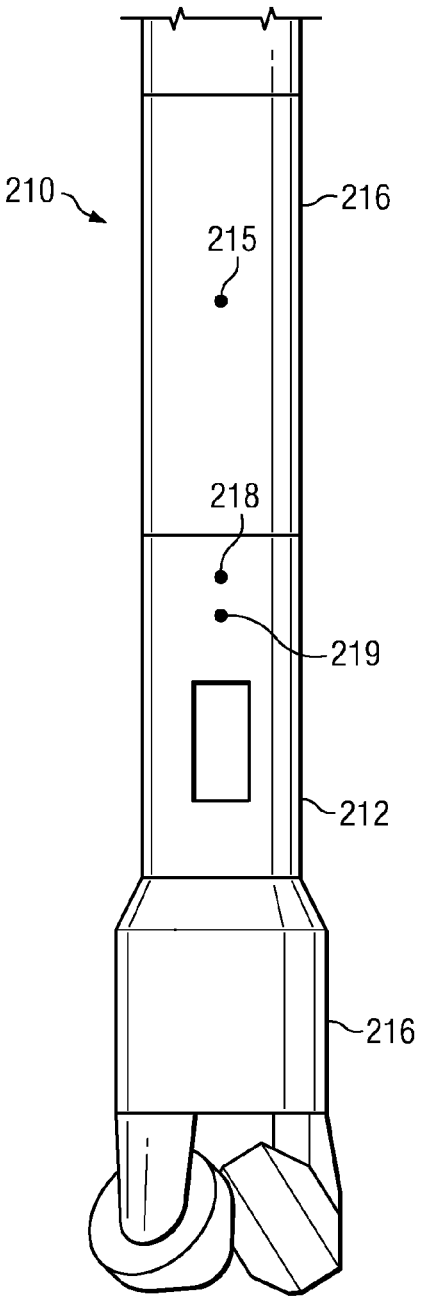
FIG. 8 depicts an alternative BHA configuration suitable for employing various ones of the disclosed method embodiments.

FIG. 8 depicts an alternative BHA configuration 210 including a rotary steerable tool 212 and at least one LWD tool 214 (including at least one LWD sensor 215) deployed uphole of drill bit 216. In the depicted embodiment, tri-axial accelerometer and magnetometer sets 218, 219 are deployed in rotary steerable tool 212 and are configured to rotate with the drill bit 216. The disclosed embodiments are not limited in this regard, however, as the accelerometer and magnetometer sets 218 and 219 may be deployed substantially anywhere in the BHA 210 (e.g., in LWD tool 214 or in an MWD survey tool). Further, these sensor sets may be placed inside a downhole mud motor and/or in a rotary-steerable tool, where the rotation speed of the sensors can be significantly different from that of the drill bit. In addition, the rotation speed of the sensor sets may be controlled by a downhole controller (e.g., as disclosed in commonly assigned U.S. Pat. No. 7,950,473 which is incorporated by reference in its entirety herein). The controlled rotation speed of the sensor sets may be, for example, in a range from about 1 to about 20 rpm, while the drill bit rotates at about 100 rpm. Moreover, the use of tri-axial accelerometer and magnetometer sets are not required as first and second cross-axial accelerometers and first and second cross-axial magnetometers may likewise be utilized.

With continued reference to FIGS. 7 and 8, the dynamic gravity toolface computed at 150 of method 140 may be processed in combination with LWD data acquired by LWD sensor 215 to obtain an LWD image. Moreover, the dynamic gravity toolface may be further processed by rotary steerable tool 212 to compute a direction of subsequent drilling of a borehole (or new positions for steering members in the tool 212).

Upon computing the cross-axial magnetic field component $B_{xy}$, the toolface offset (T−M), and the borehole inclination I, the borehole azimuth Azi may then be computed, for example, via solving Equation 5. Such a solution commonly includes either two or four roots. Certain of these roots may be discarded, since it is known that the sign (positive or negative) of sin(Azi) is opposite to the sign of Q in Equation 5. In other words, when Q is negative, the borehole azimuth lies between zero and 180 degrees and when Q is positive, the borehole azimuth lies between 180 and 360 degrees.

Any suitable root finding algorithm may be utilized to solve Equation 5. For example, it may be sufficient to evaluate the equation at some number of trial values (e.g., at one degree increments within the 180 degree span described above). Zero-crossings may then be located between trial values that return opposing signs (e.g., a positive to negative transition or visa versa). A possible root of Equation 5 may then be found by interpolation or by further evaluating the equation at smaller increments between the trial values. Other known methods for finding zero-crossings include, for example, the Newton-Raphson method and the Bisection method. When all possible roots $Azi_{root}$ have been found within the 180 degree trial range, they may be discriminated, for example, via using each root to compute a hypothetical earth's field and comparing those hypothetical fields with a reference field. This may be represented mathematically, for example, as follows:

$$Bz_{root}=B\cos D\sin I\cos Azi_{root}+B\sin D\cos I; \quad \text{Equation 9}$$

$$Bv_{root}=Bz_{root}\cos I-B_{xy}\sin I\cos(T-M); \quad \text{Equation 10}$$

$$Bh_{root}=\sqrt{B_{xy}^2+Bz_{root}^2-Bv_{root}^2}; \text{ and} \quad \text{Equation 11}$$

$$\delta B=\sqrt{(B\cos D-Bh_{root})^2+(B\sin D-Bv_{root})^2} \quad \text{Equation 12}$$

where B, D, I, T, and M are as defined above, $Azi_{root}$ represents one of the roots of Equation 5, $Bz_{root}$, $Bv_{root}$, and $Bh_{root}$ represents axial, vertical, and horizontal components of the hypothetical earth's magnetic field computed for a borehole azimuth of $Azi_{root}$, and δB represents the difference between the hypothetical earth's magnetic field and the reference magnetic field as a vector distance. The borehole azimuth value $Azi_{root}$ that returns the smallest value of δB may be considered to be the correct root (and hence the hypothetical earth's field may be considered to be the calculated earth's field). Moreover, the numeric value of δB may be advantageously used as an indicator of survey quality (with smaller values indicating improved quality) since it represents the difference between the calculated (hypothetical) earth's field and the reference field.

As described above, method 100 provides for making dynamic borehole azimuth while drilling measurements without requiring an axial magnetic field measurement. The method has been found to provide suitable accuracy under many drilling conditions. The reliability of the computed azimuth, however, tends to decrease in near horizontal wells having an approximately east-west orientation. An alternative methodology may be utilized at such wellbore attitudes.

Figure 6:
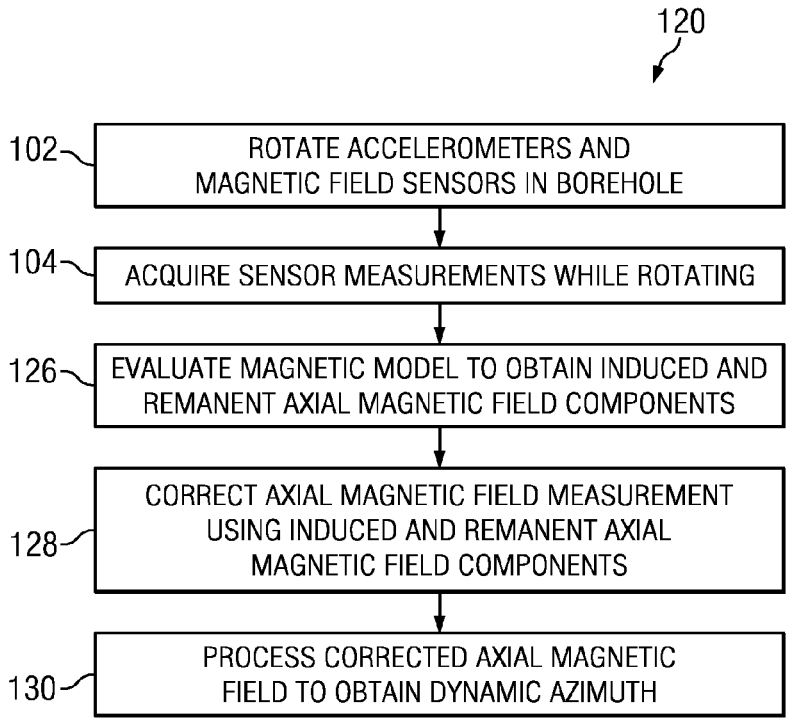
FIG. 6 depicts a flow chart of another disclosed method embodiment.

FIG. 6 depicts a flow chart of one such alternative method 120 for making dynamic borehole azimuth measurements while drilling. Navigational sensors are rotated in a borehole at 102 and used to acquire gravitational field and magnetic field measurements at 104 as described above with respect to FIG. 3. A mathematical magnetic model is evaluated at 126 to obtain induced and remanent axial magnetic field components. The induced and remanent magnetic field components are processed at 128 in combination with an axial magnetic field measurement made at 104 to obtain a corrected axial magnetic field component. The corrected axial magnetic field component is then processed at 130 in combination with other of the measurements made at 104 to obtain a dynamic borehole azimuth.

In one aspect a method for making a dynamic borehole azimuth measurement while rotating a downhole measurement tool in a borehole includes: (a) rotating a downhole tool in the borehole, the downhole tool including an axial magnetic field sensor, a cross-axial magnetic field sensor, an axial accelerometer, and a cross-axial accelerometer; (b) obtaining a set of axial magnetic field measurements, a set of cross-axial magnetic field measurements, a set of axial accelerometer measurements, and a set of cross-axial accelerometer measurements while the downhole tool rotates in (a); (c) evaluating a magnetic model to obtain an induced axial magnetic field component and a remanent axial magnetic field component; (d) correcting the set of axial magnetic field measurements by using the remanent axial magnetic field component as a bias and the induced axial magnetic field component as a scale factor to obtain a corrected axial magnetic field component; and (e) processing the corrected axial magnetic field component to compute the dynamic borehole azimuth.

With continued reference to FIG. 6, in method 120 the measured value of the axial magnetic field component $B_z$ is corrected using a bias and a scale factor. The axial bias is obtained from an axial component of the remanent magnetization in the drill string (e.g., from the mud motor and/or the drill bit). As is known to those of ordinary skill in the art, such remanent magnetization is commonly the result of magnetic particle inspection techniques used in the manufacturing and testing of downhole tools. The measured axial magnetic field component may then be modeled, for example, as follows:

$$B_z=Be_z(1+SBi_z)+Br_z \quad \text{Equation 13}$$

where $B_z$ represents the measured axial magnetic field component, $Be_z$ represents the axial component of the earth's magnetic field (also referred to as the corrected axial magnetic field component), $SBi_z$ represents the scale factor error due to induced magnetization and $Br_z$ represents the axial bias due to remanent magnetization.

The scale factor error $SBi_z$ and the axial bias $Br_z$ may be obtained using various methodologies. For example, the scale factor error may be estimated based upon the known dimensions and material properties of the magnetic collar. The axial magnetic flux emanating from the end of a magnetic collar may be expressed mathematically, for example, as follows:

$$F=\frac{Be_z\mu_r\pi(Di^2-d^2)}{4} \quad \text{Equation 14}$$

where F represents the axial magnetic flux, $\mu_r$ represents the relative permeability of the magnetic collar, and d and Di represent the inner and outer diameter of the magnetic collar. When the flux F is considered to emanate from an induced magnetic pole, the induced axial field $Bi_z$ at a distance L may be expressed mathematically, for example, as follows:

$$Bi_z = \frac{F}{4\pi L^2} \quad \text{Equation 15}$$

The induced magnetization may be represented mathematically as a scale factor error, for example, as follows:

$$SBi_z = \frac{Bi_z}{Be_z} = \frac{\mu_r(Di^2 - d^2)}{16L^2} \quad \text{Equation 16}$$

It should be noted in applying Equation 16, that flux leakage may cause the end of a magnetic collar to behave as though the pole location is few inches within the collar (i.e., not exactly at the end of the collar). This may be taken into account when estimating a value for the sensor spacing L.

The axial bias $Br_z$ may be determined from azimuth measurements made at previous survey stations. For example, Equation 9 may be used to compute the axial component of the earth's magnetic field (where $Be_z = Bz_{root}$) at a previous survey station. Substituting the values of $B_z$ and $Be_z$ from the previous station and the constant $SBi_z$ into Equation 13 provides a solution for the axial bias $Br_z$. Both the scale factor error and the axial bias may then be considered as constants in the subsequent use of Equation 13 thereby allowing a direct transformation of the measured axial magnetic field component $B_z$ to an estimate of the axial component of the earth's magnetic field $Be_z$.

The scale factor error and the axial bias may also be obtained from azimuth measurements made at multiple previous survey stations using a form of multi-station analysis. For example, the measured axial magnetic field components taken at the multiple survey stations may be plotted against the corresponding axial components of the earth's magnetic field computed in Equation 9. The result in an approximately linear plot having a vertical axis intercept at the axial bias value $Br_z$ and a slope of $1+SBi_z$ (which may be substituted into Equation 13 or from which the scale factor error may be readily obtained). As stated above, the scale factor error and the axial bias may then be considered as constants in Equation 13 allowing a direct transformation of the measured axial magnetic field component to an estimate of the axial component of the earth's magnetic field.

Upon obtaining an estimate of the axial component of the earth's magnetic field, the borehole azimuth Azi may be computed, for example, using Equation 4 given above or the following mathematical relation:

$$\tan Azi = \frac{-B_{xy}\sin(T-M)}{Be_z \sin I + B_{xy}\cos I\cos(T-M)} \quad \text{Equation 17}$$

where $B_{xy}$ represents the magnitude of the cross-axial magnetic field component (obtained for example as described above with respect to Equations 1-3), (T−M) represents the toolface offset between the gravity toolface T and the magnetic toolface (obtained for example as described above with respect to Equations 6-8), and I represents the borehole inclination.

The survey quality obtained using Equation 17 may be indicated, for example, by using the inputs $B_{xy}$, $Be_z$, I, and (T−M) to compute the magnitude B and dip D of the earth's magnetic field, for example, as follows and comparing these values with the aforementioned reference values:

$$B = \sqrt{B_{xy}^2 + Be_z^2}\text{; and} \quad \text{Equation 18}$$

$$\sin D = \frac{Be_z\cos I - B_{xy}\sin I\cos(T-M)}{B} \quad \text{Equation 19}$$

The dynamic borehole azimuth values may be computed while drilling using uphole and/or downhole processors (the disclosed embodiments are not limited in this regard). In one or more embodiments, the dynamic borehole inclination I, the magnitude of the cross-axial magnetic field component $B_{xy}$, the toolface offset (T−M), and the rotation rate of the drill collar R are computed downhole and transmitted to the surface at some predetermined interval (e.g., at 30 or 60 second intervals) while drilling. These values are then used to compute the borehole azimuth at the surface, for example, using Equations 5 and 9-12. The toolface offset may also be corrected for rotation rate at the surface. Alternatively, $A_z$ (or I) and $B_{xy}$ may be computed downhole and transmitted to the surface. Equation 4 may then be used to compute the dynamic borehole azimuth at the surface. A one-bit east west indicator may also be computed downhole and transmitted to the surface. An east west indicator may include, for example, computing the following summation over a predetermined number of measurements $\Sigma(A_xB_y - A_yB_x)$ such that a positive value indicates an east side dynamic borehole azimuth (binary 1) and a negative value indicates a west side dynamic borehole azimuth (binary 0). The use of an east west indicator may be advantageous when the BHA is aligned close to magnetic north south (e.g., within 10 degrees).

Moreover, the gravity tool face and/or the various correction factors or bias errors may also be computed either using either uphole or downhole processors. For example, the raw navigational sensor measurements may be transmitted uphole via a high bandwidth datalink and used to compute at the surface the various parameters disclosed herein. These parameters may then be transmitted downhole. Alternatively, the processing may take place elsewhere in the drilling string (e.g., in an LWD tool or a rotary steerable tool). In such an embodiment, the navigational sensor data and the computed parameters may be transmitted back and forth between various downhole tools using a downhole communication bus or electromagnetic short-hop telemetry techniques. The disclosed embodiments are not limited in any of these regards.

It will be understood that while not shown in FIGS. 1 and 2, downhole measurement tools suitable for use with the disclosed embodiments generally include at least one electronic controller. Such a controller typically includes signal processing circuitry including a digital processor (a microprocessor), an analog to digital converter, and processor readable memory. The controller typically also includes processor-readable or computer-readable program code embodying logic, including instructions for computing various parameters as described above, for example, with respect to Equations 1-19. One skilled in the art will also readily recognize some of the above mentioned equations may also be solved using hardware mechanisms (e.g., including analog or digital circuits).

A suitable controller typically includes a timer including, for example, an incrementing counter, a decrementing timeout counter, or a real-time clock. The controller may further include multiple data storage devices, various sensors, other controllable components, a power supply, and the like. The controller may also optionally communicate with other instruments in the drill string, such as telemetry systems that communicate with the surface or an EM (electro-magnetic) shorthop that enables the two-way communication across a downhole motor. It will be appreciated that the controller is not necessarily located in the sensor sub (e.g., sub 60), but may be disposed elsewhere in the drill string in electronic communication therewith. Moreover, one skilled in the art will readily recognize that the multiple functions described above may be distributed among a number of electronic devices (controllers).

Although dynamic borehole azimuth measurements and certain advantages thereof have been described in detail, it should be understood that various changes, substitutions and alternations can be made herein without departing from the spirit and scope of the disclosure as defined by the appended claims.

What is claimed is:

1. A method of drilling in a borehole, comprising:

(a) deploying and rotating a bottom hole assembly (BHA) in the borehole, the bottom hole assembly comprising a downhole tool, a drill bit, and a steering tool, the downhole tool including first and second cross-axial magnetic field sensors and first and second cross-axial accelerometers;

(b) causing the downhole tool to make first and second cross-axial magnetic field measurements and first and second cross-axial accelerometer measurements while the downhole tool is rotating in (a), wherein the first and the second cross-axial magnetic field measurements do not include a z-axis magnetic field measurement;

(c) processing the cross-axial magnetic field measurements obtained in (b) to compute a magnetic toolface;

(d) processing the cross-axial magnetic field measurements and the cross-axial accelerometer measurements obtained in (b) to compute a dynamic toolface offset, wherein the dynamic toolface offset is computed over a plurality of measurements according to the following equation:

$$T - M = \arctan\left[\frac{\sum (B_x A_y - B_y A_x)}{-\sum (B_x A_x + B_y A_y)}\right]$$

wherein T−M represents the dynamic toolface offset with T representing a gravity toolface and M representing the magnetic toolface, $B_x$ and $B_y$ represent the first and second cross-axial magnetic field measurements, and $A_x$ and $A_y$ represent the first and second cross-axial accelerometer measurements;

(e) processing the magnetic toolface computed in (c) and the dynamic toolface offset computed in (d) to compute a dynamic gravity toolface;

(f) processing the gravity toolface computed in (e) in a rotary steerable tool deployed in the BHA to compute a direction of subsequent drilling of the wellbore; and (g) adjusting the rotary steerable tool to change a direction of drilling along the direction of subsequent drilling computed in (f).

2. The method of claim 1, wherein the magnetic toolface is computed in (c) according to a following mathematical equation of:

$$M = \arctan\frac{B_x}{B_y}$$

3. The method of claim 1, wherein (d) further comprises:

(i) processing the cross-axial magnetic field measurements and the cross-axial accelerometer measurements obtained in (b) to compute a preliminary dynamic toolface offset;

(ii) processing the magnetic tool face obtained in (c) to compute a rotation rate of the downhole tool; and (iii) processing the preliminary dynamic toolface offset and the rotation rate of the downhole tool to compute the dynamic toolface offset.

4. The method of claim 3, wherein (iii) comprises correcting the preliminary dynamic toolface offset to a zero-rpm equivalent value.

5. The method of claim 1, further comprising:

(h) processing the dynamic gravity toolface computed in (e) in combination with logging while drilling data to create a logging while drilling image.

6. The method of claim 1, wherein the downhole tool is one of a logging while drilling tool and a rotary steerable tool.

7. The method of claim 1, where (a) further comprises utilizing a downhole controller to control a rotation rate of the downhole tool with respect to the borehole.

8. The method of claim 1, wherein the downhole tool and the steering tool are within the same housing.

9. The method of claim 1, wherein (g) comprises extending one or more blades on the rotary steerable tool to change the direction of drilling along the direction of subsequent drilling computed in (f).

* * * * *